US012043974B2

(12) United States Patent
Reinhardt

(10) Patent No.: US 12,043,974 B2
(45) Date of Patent: Jul. 23, 2024

(54) SPECIALIZED CIVIL ENGINEERING MACHINE, IN PARTICULAR SLOTTED WALL MILLING MACHINE

(71) Applicant: LIEBHERR-WERK NENZING GMBH, Nenzing (AT)

(72) Inventor: Hans Reinhardt, Bürs (AT)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 515 days.

(21) Appl. No.: 17/299,009

(22) PCT Filed: Oct. 17, 2019

(86) PCT No.: PCT/EP2019/078134

§ 371 (c)(1),
(2) Date: Jun. 2, 2021

(87) PCT Pub. No.: WO2020/114656

PCT Pub. Date: Jun. 11, 2020

(65) Prior Publication Data

US 2022/0049449 A1 Feb. 17, 2022

(30) Foreign Application Priority Data

Dec. 6, 2018 (DE) ..... 10 2018 131 226.1

(51) Int. Cl.

| | |
|---|---|
| ***E02D 17/13*** | (2006.01) |
| ***E02D 3/12*** | (2006.01) |
| ***E02F 3/20*** | (2006.01) |
| ***E02F 3/24*** | (2006.01) |

(52) U.S. Cl.

CPC ..... *E02D 17/13* (2013.01); *E02D 3/12* (2013.01); *E02F 3/205* (2013.01); *E02F 3/246* (2013.01)

(58) Field of Classification Search

CPC .. E02D 17/13; E02D 3/12; E02F 3/205; E02F 3/246

See application file for complete search history.

(56) References Cited

U.S. PATENT DOCUMENTS 3,153,160 A 10/1964 Carle

FOREIGN PATENT DOCUMENTS

| | | | |
|---|---|---|---|
| EP | 0 518 293 | B1 | 8/1994 |
| EP | 1529924 | A1 | 5/2005 |
| EP | 1630298 | A1 | 3/2006 |
| EP | 1703023 | A1 | 9/2006 |
| EP | 2667036 | A1 | 11/2013 |
| FR | 2806111 | A1 | 9/2001 |
| GB | 619082 | A | 3/1949 |

(Continued)

*Primary Examiner* — Tara Mayo

(74) *Attorney, Agent, or Firm* — Dilworth & Barrese, LLP

(57) ABSTRACT

The present invention relates to a special civil engineering machine, in particular a slurry wall cutter, comprising at least one rotating tool and a tool drive that is arranged within a housing of the special civil engineering machine and is sealed with respect to the environment by means of at least one bearing seal in the region of its shaft exit from the housing to the driven tool, characterized in that the bearing seal comprises at least two separate sealing elements, whose arrangement forms a sealing chamber located between the sealing elements, wherein a pressure compensation device is provided, which controls the chamber pressure in the sealing chamber in dependence on the ambient pressure of the special civil engineering machine.

18 Claims, 2 Drawing Sheets

(56) References Cited

FOREIGN PATENT DOCUMENTS

| | | | |
|---|---|---|---|
| JP | 6-316932 | A | 11/1994 |
| JP | H10-331187 | A | 12/1998 |
| JP | 2013-245821 | A | 12/2013 |

SPECIALIZED CIVIL ENGINEERING MACHINE, IN PARTICULAR SLOTTED WALL MILLING MACHINE

BACKGROUND OF THE INVENTION

This invention relates to a special civil engineering machine, in particular a slurry wall cutter, comprising at least one rotating tool and at least one tool drive that is arranged within a housing of the machine tool and in the region of its shaft outlet towards the driven tool includes at least one bearing seal for sealing the housing interior with respect to the environment.

In special civil engineering, deep ground excavations, e.g. down to depths of 100 meters or more, are carried out by means of special milling or drilling tools. As the geometry of the very slender excavation pit thus obtained does not permit the installation of formwork to support the soil, a supporting liquid is used while the excavation work is still in progress, which usually consists of water, clay minerals and other aggregates.

Depending on the penetration depth and the liquid density, the implement immersed in the supporting liquid is exposed to a pressure load from outside which increases with increasing depth. Due to the content of water and minerals, which can have a corrosive and abrasive effect on mechanical components of the tool drive, the ingress of supporting liquid into the drive must always be reliably prevented.

Frequently used sealing systems mostly provide mechanical seals that have to be pressurized from inside with a specially generated pressure, which ideally should be slightly above the prevailing external pressure. Such solutions frequently proceed from a drive housing of a wall chaser whose interior space is filled with transmission oil and an adaptation of the pressure level is effected via a hydraulic adjusting piston.

However, it is a disadvantage of the presented solution that the complete drive housing must be filled with oil in order to be able to accomplish the pressure change in the housing with an acceptable system size of adjusting piston, expansion tank or the like. In particular in use of transmissions, this leads to considerable efficiency losses due to hydrodynamic processes (so-called flanging), accompanied by considerable thermal stress on lubricants, bearings and sealing materials.

Moreover, due to friction losses of the piston seal, this system is subject to an unavoidable hysteresis which in particular with low working depths and a changing direction of movement of the implement impairs the accuracy of the pressurization.

An alternative solution is known from EP 1 529 924 A1. Here, an electronic solution is employed, which suggests a sensor-based active measurement of the pressure level, corresponding signal processing and subsequent pressure control by means of an electronic control unit. Sensor-based systems with active pressure control, however, definitely need a damping device in order to be able to compensate shifting operations and process possible control deviations.

SUMMARY OF THE INVENTION

Therefore, it is the object of the present invention to look for an alternative solution that is able to at least partly overcome the above-mentioned problem.

This object is achieved by a special civil engineering machine, in particular a slurry wall cutter, according to the features herein. Advantageous embodiments of the special civil engineering machine are subject-matter of the description herein.

According to the invention, it is proposed to construct the at least one bearing seal of the special civil engineering machine from at least two separate sealing elements. By arranging the separate sealing elements relative to each other in accordance with the invention, a sealing chamber is formed between the sealing elements, which can be subjected to a definable pressure level. In terms of pressure, this pressure chamber is separated from the remaining housing space. The pressure level prevailing there acts on at least one of the sealing elements in such a way that its sealing effect is ensured and the housing interior or the sealing chamber is outwardly sealed with respect to the ambient pressure.

Depending on the penetration depth and the liquid density, the special civil engineering machine immersed in the excavation pit and in particular within a liquid is exposed to a pressure load from outside which increases with increasing depth. In the following, this pressure load will be referred to as ambient pressure for reasons of simplicity. The pressure level in the sealing chamber now has to be adjusted by a pressure compensation device in such a way that said pressure level is equal to or higher than the ambient pressure, as this is the only way to ensure a satisfactory sealing effect of the at least one sealing element.

The special civil engineering machine in particular is a slurry wall cutter comprising one or more cutting wheels as tool, which are put into rotation via at least one cutter drive accommodated in a housing. In the region of the drive shaft exiting from the housing, the corresponding bearing seal is provided with the configuration according to the invention.

In contrast to the prior art, it is no longer necessary to provide a corresponding pressure level in the entire housing space, but it is sufficient to build up pressure in a separate, comparatively small-volume sealing chamber. This not only allows a faster reaction to changes of the external pressure, but avoids a negative influence on the tool drive. Other than requested in the prior art, the tool drive or cutter drive no longer has to be operated with an excess amount of transmission oil, but instead the oil quantity required for regular operation can be used. As a result, both the efficiency and the lubricant lifetime can be optimized.

According to an advantageous embodiment of the invention, the sealing chamber is sealed with respect to the environment by an outer sealing element, wherein the outer sealing element preferably has a sufficient material resistance to a substance, in particular liquid, surrounding the special civil engineering machine in special civil engineering. When the special civil engineering machine is a slurry wall cutter, the outer sealing element is sufficiently resistant to a supporting liquid filled into the slot, which mostly consists of water, clay minerals and further aggregates. In particular, such a sealing element is able to withstand the abrasive and corrosive properties of the surrounding supporting liquid. To do so, however, it needs the required pressure from the sealing chamber. Preferably, the outer sealing element is a mechanical seal.

As an inner sealing element, i.e. the sealing element that seals the sealing chamber with respect to the tool drive or transmission space, a distinctly less material-resistant sealing element can be used, as the same does not get in contact with the aforementioned contaminations of the supporting liquid, but merely with the pressure medium used within the sealing chamber on the one hand or substances possibly present within the tool drive/transmission space, in particular the transmission oil. This flexibility gained in the selection of the appropriate sealing material involves the advantage that here a material not resistant to pressure can be used, whose sealing effect is present, however, regardless of the pressure. What is suitable here, for example, is an elastomer seal.

The sealing chamber can be hermetically sealed, i.e. with respect to the ambient pressure and/or the housing space or transmission space. It is likewise imaginable that instead at least one pressure relief is provided towards the housing space or transmission space. For example, the sealing chamber is relieved towards the housing space, in particular transmission space, via at least one throttle.

For realizing the present invention, any kind of pressure compensation device can be used in principle, which is suited to adjust the pressure level present within the sealing chamber in dependence on the ambient pressure. Particularly preferably, such a pressure level should be slightly higher than the ambient pressure so that a sufficient sealing effect of the outer seal can be ensured.

According to an advantageous embodiment of the invention, a newly designed pressure compensation device is employed, which comprises at least one pump whose pressure outlet is directly or indirectly connected to the sealing chamber in order to pressurize the latter with the required chamber pressure in dependence on the ambient pressure. For example, a throttle can be integrated between the pressure side of the pump and the sealing chamber.

According to a particularly preferred embodiment of the invention, the suction side of the pump is connected to the housing interior of the tool drive, in particular to the transmission space of the cutter drive. The pressure outlet of the pump is connected to the sealing chamber. The pump sucks in a volume flow of a substance present in the transmission space, in particular transmission oil, and at least partly pumps the same into the sealing chamber.

At this point, it is particularly preferred when the pump used sucks in a constant (small) volume flow from the transmission space. For adjusting the desired pressure level within the sealing chamber, a pressure limiting valve can be installed on the pressure side of the pump, whose pressure inlet is connected to the pressure side of the pump. Accordingly, only a part of the aspirated volume flow of the pump ultimately is delivered to the sealing chamber, excess fluid is discharged via the pressure limiting valve.

This switching arrangement provides for an exact adjustment of the pressure level achieved within the sealing chamber by adaptation of the degree of opening of the pressure limiting valve. Due to the targeted adjustment of the opening pressure, the achievable pressure level in the sealing chamber can be influenced and adjusted with sufficient accuracy. A change of the absorption volume of the pump is not necessary for this purpose.

Preferably, the pressure limiting valve used is pilot-controlled in order to be able to correspondingly adjust the opening pressure and hence the desired setpoint pressure level within the sealing chamber. Ideally, the control pressure port is connected to a membrane via a control pressure volume. What acts on the membrane is the control pressure volume on the one hand and the ambient pressure on the other hand, so that changes of the ambient pressure automatically lead to an adaptation of the opening pressure of the pressure limiting valve. For example, an increase of the ambient pressure leads to a corresponding increase of the control pressure, whereby the setpoint pressure level within the sealing chamber ultimately is adapted correspondingly.

When the pressure limiting valve and the pump are suitably dimensioned, it can be achieved that the pressure level within the sealing chamber is exactly adjusted to the ambient pressure or to an exact difference to the ambient pressure. For adjusting a desired pressure difference, an additional direct actuation of the pressure limiting valve by means of spring bias can be provided. The spring bias acts on the pressure limiting valve, i.e. the valve piston, against the control pressure, so that the spring bias defines the desired pressure difference between the pressure level within the sealing chamber and the ambient pressure. Ideally, there is used a pressure limiting valve with adjustable spring bias.

The outlet of the pressure limiting valve for example can be directly connected to the transmission space of the tool drive or cutter drive in order to pass the transmission oil back to the housing or transmission space in the sense of a closed circuit. This procedure has the advantage that there is a constant volume flow through the pressure limiting valve so that there is a constant movement of the valve piston, and disadvantageous hysteresis effects like in the prior art can be avoided thereby.

Furthermore, it is imaginable that by means of the hydraulic oil fed back such components of the tool or cutter drive are lubricated, which in regular operation cannot or not sufficiently be lubricated.

In addition, the realization of the proposed oil circuit of the transmission oil allows to use additional components, such as for example an oil filter, a heat exchanger or also another analysis device for monitoring and evaluating the oil properties. By means of the heat exchanger, for example, a sufficient cooling of the transmission oil can be provided, while the filter permits to clean the transmission oil in operation. The analysis device for example can serve to detect possible contaminations of the transmission oil in due time and thereby infer a decreasing sealing effect of the bearing seal. The aforementioned components preferably are installed in the return line from the pressure limiting valve to the transmission space.

BRIEF DESCRIPTION OF THE DRAWINGS

Further advantages and properties of the invention will be explained in detail below with reference to exemplary embodiments. In the drawing.

DESCRIPTION OF THE PREFERRED EMBODIMENTS

Figure 1:
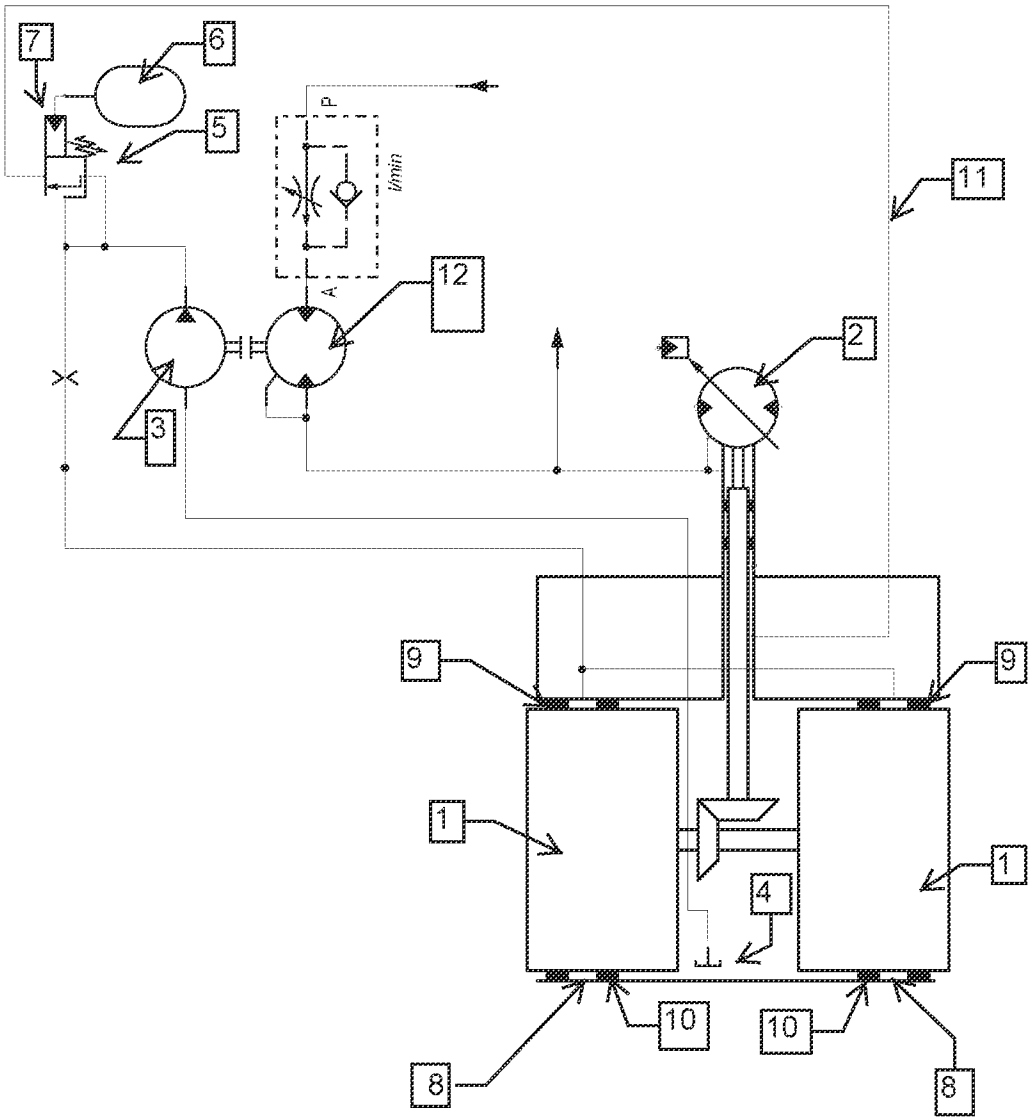
FIG. 1: shows a hydraulic circuit diagram of the slurry wall cutter of the invention according to a first exemplary embodiment.

FIG. 1 shows a hydraulic circuit diagram for a slurry wall cutter according to the invention, which comprises a non-illustrated housing in which a cutter drive is accommodated. The cutter drive comprises the two milling wheel gears 1, which are driven by a common hydraulic motor 2. A plurality of drive shafts exit from the housing, which must be sealed via the bearing seals 9, 10 yet to be explained in detail below.

Regardless of the state of movement of the milling wheel drive and therefore separately supplied with energy via a constant hydraulic drive 12, a pump unit 3 sucks in a small constant oil flow from the transmission interior 4, which flows through the pressure limiting valve 5. The pressure limiting valve 5 has an adjustable spring bias and a control pressure port 7. Via the membrane 6, the ambient pressure acts directly on an oil volume that acts on the control pressure port 7 of the valve 5.

The pressure generated by the pump 3 and controlled by means of the pressure limiting valve 5 is applied to the oil-filled sealing chamber 8, which is sealed against the environment by a mechanical seal 9 and by an elastomer seal 10 against the interior space of the transmission 1.

Due to the high content of air in the total volume of the transmission interior, atmospheric pressure more or less exists in the transmission space 4 in dependence on the temperature, regardless of the penetration depth of the drive in the supporting liquid. On the other hand, the ambient pressure in the supporting liquid with the usual working depths can assume values between atmospheric pressure and about 20-25 bar.

The seals 9 and 10 divide the entire sealing task of the bearing seal into two sub-tasks for which they are each designed:

Seal 9 is able to withstand the abrasive and corrosive properties of the surrounding supporting liquid, but to do so needs a pressure in the sealing chamber 8 that is to be maintained as exactly as possible and lies about 2 bar above the pressure of the surrounding supporting liquid, with a tolerance of less than 1 bar.

Seal 10 can withstand the potentially high differential pressure between environment and transmission interior, but to do so requires the cleanliness of the surrounding fluids.

The pressure limiting valve 5 influences the pressure in the sealing chamber 8 by adding the spring pressure (2 bar) to the ambient pressure in the control port 7. In addition, the valve 5 is constantly flown through and thus its valve piston is kept moving, whereby pressure peaks are avoided and possible hysteresis effects are kept low.

The circulating oil is again supplied to the transmission 1 via the return line 11. In an advantageous embodiment, this returning oil is used for lubricating transmission parts whose oil wetting is not ensured by the general operation.

In another advantageous embodiment or in an extension of the function, heat exchangers, filters and devices for oil analysis can be integrated into the line 11 in order to dissipate heat, remove gear abrasion from the oil and reveal a decrease in the sealing effect, in particular by detecting components of the supporting liquid in the oil.

In its basic configuration, the presented system can do without electronic components and without any further control effort. The sealing effect of the bearing seal is maintained even upon failure of all control systems as long as the drive unit of the entire system is in operation.

Figure 2:
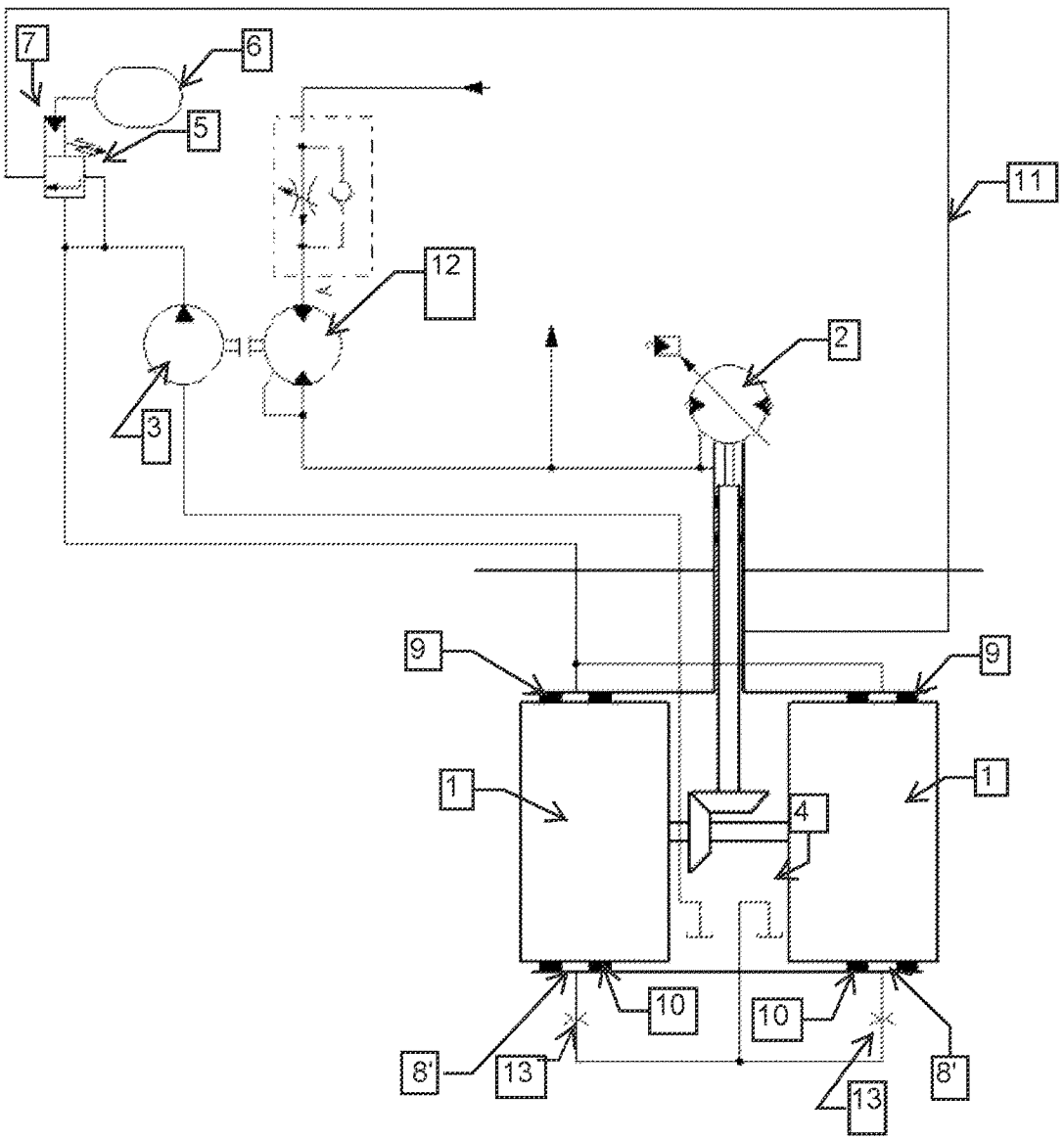
FIG. 2: shows a hydraulic circuit diagram of a configuration slightly modified with respect to the exemplary embodiment of FIG. 1.

In the embodiment of FIG. 2, which is slightly modified with respect to FIG. 1, the sealing chambers 8' are not hermetically sealed, but instead relieved into the transmission space 4 via throttles 13. Such a modification permits a dissipation of heat from the sealing chamber 8' and an oil exchange and oil purification of the sealing chamber 8'. The remaining design of the embodiment of FIG. 2 is identical to FIG. 1, which is why identical reference numerals have been used.

The invention claimed is:

1. A civil engineering machine, comprising at least one rotating tool and a tool drive arranged within a housing of the civil engineering machine and sealed with respect to the environment by at least one bearing seal in a region of a shaft exit from the housing to a driven tool, wherein the bearing seal comprises at least two separate sealing elements, whose arrangement forms a sealing chamber located between the sealing elements, and additionally comprising a pressure compensation device which controls pressure in the sealing chamber in dependence on ambient pressure of the civil engineering machine.

2. The civil engineering machine according to claim 1, wherein an outer one of the sealing elements seals the sealing chamber with respect to the environment, the outer sealing element has material-resistant properties with respect to a supporting liquid surrounding the sealing element, and the outer sealing element is configured as a mechanical seal.

3. The civil engineering machine according to claim 1, wherein an inner one of the sealing elements seals the sealing chamber with respect to the housing, and the inner sealing element provides a pressure-independent sealing effect.

4. The civil engineering machine according to claim 3, wherein the inner sealing element seals the sealing chamber with respect to a transmission space of the tool drive.

5. The civil engineering machine according to claim 3, wherein the inner sealing element is an elastomer seal.

6. The civil engineering machine according to claim 1, wherein the sealing chamber is hermetically sealed with respect to the environment of the civil engineering machine and/or the housing or a transmission space of the tool drive.

7. The civil engineering machine according to claim 6, wherein a pump sucks in lubricant from the housing or a transmission space of the tool drive and pumps the same into the sealing chamber.

8. The civil engineering machine according to claim 6, additionally comprising a pump, wherein at a pressure outlet of the pump, a pressure limiting valve is provided to adjust a generated chamber pressure, and the pressure limiting valve provides a control pressure port connected to a membrane via a control pressure volume, by which membrane changes of the ambient pressure are forwarded to the control pressure volume in the control pressure port.

9. The civil engineering machine according to claim 8, wherein by the return flow from the pressure limiting valve, an active oil lubrication of drive or transmission components of the tool drive is effected, whose lubrication otherwise is not ensured during operation.

10. The civil engineering machine according to claim 1, wherein the sealing chamber is relieved towards the housing via at least one throttle.

11. The civil engineering machine according to claim 10, wherein the sealing chamber is relieved towards a transmission space via said at least one throttle.

12. The civil engineering machine according to claim 1, wherein the pressure compensation device comprises a pump whose pressure outlet is connected to the sealing chamber to pressurize the same with the required chamber pressure in dependence on the ambient pressure.

13. The civil engineering machine according to claim 12, comprising a pressure limiting valve which is spring-biased, and a setpoint differential pressure between the chamber pressure and the ambient pressure is adjustable via the spring bias.

14. The civil engineering machine according to claim 13, wherein the pressure limiting valve has an adjustable spring bias.

15. The civil engineering machine according to claim 12, wherein an outlet of a pressure limiting valve is connected to the housing.

16. The civil engineering machine according to claim 15, wherein the outlet of the pressure limiting is connected to a transmission space of a tool drive.

17. The civil engineering machine according to claim 1, wherein in a return line from a pressure limiting valve to the housing, at least one heat exchanger and/or oil filter and/or oil analysis device is integrated.

18. The civil engineering machine according to claim 1, wherein the pressure compensation device comprises a pump whose pressure outlet is connected to the sealing chamber to pressurize the same with the required chamber pressure in dependence on the ambient pressure, and the pump is adapted to suck in lubricant from the housing or a transmission space of the tool drive and pump the lubricant into the sealing chamber.

* * * * *